252-105 AU 166 EX
5/1/84 OR 4,446,043

United States Patent [19]
Tai

[11] 4,446,043
[45] May 1, 1984

[54] BUILT LIQUID DETERGENT COMPOSITIONS

[75] Inventor: Ho T. Tai, Santes, France

[73] Assignee: Lever Brothers Company, New York, N.Y.

[21] Appl. No.: 410,671

[22] Filed: Aug. 23, 1982

[30] Foreign Application Priority Data

Sep. 1, 1981 [GB] United Kingdom ..... 8126444

[51] Int. Cl.³ ..... C11D 3/06; C11D 7/56
[52] U.S. Cl. ..... 252/105; 252/94; 252/109; 252/530; 252/540; 252/DIG. 14
[58] Field of Search ..... 252/105, 109, 110, 531, 252/532, 533, 535, 536, 539, 540, DIG. 14, 94, 530

[56] References Cited

U.S. PATENT DOCUMENTS

| | | | |
|---|---|---|---|
| 3,203,900 | 8/1965 | Carroll et al. | 252/110 |
| 3,232,878 | 2/1966 | Jones et al. . | |
| 3,503,885 | 3/1970 | Wedell | 252/105 |
| 3,700,601 | 10/1972 | Bloching | 252/105 |
| 3,707,503 | 12/1972 | Kenny | 252/117 |
| 3,741,901 | 6/1973 | Ziffer | 252/105 X |
| 3,833,517 | 9/1974 | Kling et al. | 252/545 |
| 3,954,652 | 5/1976 | Schmidt | 252/188 |
| 4,057,506 | 11/1977 | Sung . | |
| 4,082,684 | 4/1978 | Kreischer | 252/109 |
| 4,126,572 | 11/1978 | Tai . | |
| 4,228,043 | 10/1980 | van den Brom | 252/529 |
| 4,243,543 | 1/1981 | Guilbert et al. | 252/105 |
| 4,244,840 | 1/1981 | Straw . | |
| 4,268,406 | 5/1981 | O'Brien et al. | 252/105 |

FOREIGN PATENT DOCUMENTS

| | | |
|---|---|---|
| 2120424 | 11/1971 | Fed. Rep. of Germany . |
| 2447945 | 4/1975 | Fed. Rep. of Germany . |
| 1205711 | 9/1970 | United Kingdom . |
| 2021142 | 11/1979 | United Kingdom . |

*Primary Examiner*—P. E. Willis, Jr.
*Attorney, Agent, or Firm*—Milton L. Honig; James J. Farrell

[57] ABSTRACT

A stable, low viscosity, bleaching, built liquid detergent composition contains 22 to 32% by weight of sodium triphosphate; 6 to 15% by weight of an active detergent mixture of anionic sulphonate or sulphate, soap and nonionic detergent in a weight ratio of (4.5–8.5):-(0–3):(1.5–4); 2–10% by weight of an alkali metal sulphite and 0.2 to 2.0% by weight of a non-detergent short-chain alkyl-substituted benzene sulphonate having 1–4 carbon atoms in the alkyl chain. Preferred alkali metal sulphite is sodium sulphite and preferred short-chain alkyl-substituted benzene sulphonate is sodium toluene-, xylene- or cumene-sulphonate.

The bleaching liquid detergent composition is a structured liquid having a viscosity measured at 20° C. and at 21 seconds[1] shear rate of desirably not more than 0.7 Pa s.

6 Claims, No Drawings

BUILT LIQUID DETERGENT COMPOSITIONS

This invention relates to built liquid detergent compositions and to a process for preparing such compositions.

More particularly, the invention relates to structured liquids comprising high levels of sodium triphosphate and a bleaching agent, especially but not exclusively adapted for washing fabrics.

Liquid detergent compositions comprising sodium triphosphate as a builder are known in the art, e.g. from French patent application Nos. 2 247 534, 2 309 629, 2 390 497 and 2 343 806; German patent application No. 2 819 975; and U.S. Pat. Nos. 3,232,878 and 4,057,506. However, the formulation of adequate sodium triphosphate built liquid compositions having a satisfactory laundering performance is limited not only by stability problems, but also by certain viscosity boundaries as required for convenient dosing and handling, both manually and in the machine.

In European patent application No. 0.038101, published Nov. 21, 1981, stable liquid detergent compositions comprising high levels of sodium triphosphate and having a viscosity of from 0.35 to 1.0 Pascal seconds (=350–1000 Cp) are disclosed. Lately, consumers' preference has been for a viscosity of not more than 0.7 Pascal seconds, particularly below 0.6 Pascal seconds.

It has long been recognized that it is difficult to incorporate a bleaching agent in liquid detergent compositions. Most bleaching agents, including chlorine bleaches and oxidizing bleaches, such as sodium perborate, are reasonably stable in solid detergent compositions.

These bleaching agents, unless provided with a perfect protective coating, are however unstable when incorporated in aqueous liquid detergent compositions. Moreover, they tend to cause undesirable thickening and/or separation of the liquid composition, especially of compositions comprising high levels of sodium triphosphate of at least 22% by weight. Chlorine bleaches have the further disadvantage of smelling and having the tendency of causing severe damage to fabric colours, resulting in the so-called "spotting" of fabrics.

It has now been found that a stable, low viscosity bleaching liquid detergent composition comprising high levels of sodium triphosphate can be formulated by using a unique combination of a reducing bleach and a suitable hydrotrope. The amount and nature of hydrotrope must be carefully chosen to obtain the right viscosity as well as a good stability during storage. The hydrotrope usable in the present invention is a non-detergent short-chain alkyl-substituted benzene sulphonate having a total of 1–4 carbon atoms in the alkyl substituent(s). The reducing bleach usable in the present invention is an alkali metal sulphite. Preferred alkali metal sulphite is sodium sulphite. Preferred short-chain alkyl-substituted benzene sulphonates are sodium toluene sulphonate, sodium xylene sulphonate and sodium cumene sulphonate.

Accordingly, the invention provides a low viscosity built liquid detergent composition comprising from 22 to 32%, preferably from 24 to 30% by weight of sodium triphosphate and from 6 to 15%, preferably from 8 to 14% by weight of an active detergent mixture of (a) a water-soluble anionic sulphonate or sulphate detergent, (b) an alkali metal soap of fatty acids having from 12 to 18 carbon atoms, and (c) a nonionic detergent in a weight ratio of (a):(b):(c) of (4.5–8.5):(0–3):(1.5–4), which is characterized in that it further comprises 2–10% by weight of an alkali metal sulphite and 0.2–2.0% by weight of a non-detergent short-chain alkyl-substituted benzene sulphonate having 1–4 carbon atoms in the alkyl substituent(s).

The bleaching liquid detergent composition of the invention is a structured thin liquid having a viscosity measured at 20° C. and at 21 sec.$^{-1}$ shear rate desirably of not more than 0.7 Pascal seconds (Pa·s), preferably not more than 0.6 Pa·s.

Preferably the composition comprises about 4–8% by weight of alkali metal sulphite and about 0.5–1.5% by weight of the short-chain alkyl-substituted benzene sulphonate.

It is further preferred that the composition contains a soap component (b) in a ratio of (a):(b):(c) of (5.5–8.5):(0.5–3):(1.5–3).

The amount of nonionic detergent in the composition of the invention is also critical and should preferably not exceed 5% by weight of the total composition, since higher amounts tend to increase the viscosity of the liquid product.

The water-soluble anionic sulphonate detergents usable in the composition of the invention are for example the alkali metal salts of $C_{10}$–$C_{16}$ alkyl benzene sulphonates, $C_{10}$–$C_{20}$ alkane sulphonates, and $C_{10}$–$C_{20}$ olefin sulphonates, the alkali metal salts of alkyl benzene sulphonates being preferred, especially those derived from alkyl benzenes having a $C_{10}$–$C_{14}$ alkyl chain and an average molecular weight of approximately 225–245.

The water-soluble anionic sulphate detergents usable in the composition of the invention are primary and secondary alkyl sulphates and alkyl ether sulphates having an alkyl chain length of about 8 to 20 carbon atoms, preferably 12 to 18 carbon atoms, e.g. lauryl sulphate.

Typical examples of fatty acids having from 12 to 18 carbon atoms are oleic acid, ricinoleic acid, and fatty acids derived from castor oil, rapeseed oil, groundnut oil, coconut oil, palmkernel oil or mixtures thereof. The sodium or potassium soaps of these acids can be used, the potassium soaps being preferred.

Suitable nonionic detergents for use in the present invention may be found in the following classes: fatty acid alkylolamides; alkylene oxide condensates of alkyl phenols or aliphatic alcohols, alkylamines, fatty acid alkylolamides and alkyl mercaptans; and amine oxides. Ethylene oxide condensates and mixtures of ethylene oxide condensates with fatty acid alkylolamides are preferred.

Particularly suitable ethylene oxide condensates have hydrophilic-lipophylic balance (HLB) values of between 11 and 15, such as $C_{13}$–$C_{15}$ alcohols condensed with 6–8 ethylene oxides.

Without departing from the invention, the liquid detergent composition may further contain minor amounts of any of the adjuncts normally used in fabric washing compositions, e.g. sequestering agents, such as ethylene diamine tetraacetate; alkali silicates for adjusting the pH; soil-suspending and anti-redeposition agents, such as sodium carboxymethyl cellulose, polyvinyl pyrrolidone, etc.; fluorescent whitening agents; perfumes; germicides; colourants; lather-depressants; enzymes and stabilizing agents.

The invention therefore makes it possible to formulate a stable, low viscosity up to par heavy duty liquid product with stain-removing properties, so as to meet the demands made by consumer preference and machine liquid dosing equipment.

The following Examples will illustrate the invention:

EXAMPLES I–III

| Composition (wt. %) | I | II | III |
|---|---|---|---|
| Sodium $C_{12}$—alkylbenzene sulphonate | 5.0 | 6.0 | 5.0 |
| Nonionic alkoxylated alcohol | 1.8 | 2.16 | 1.8 |
| Fatty acid diethanol amide | 1.5 | 1.44 | 1.5 |
| Potassium oleate | 2.0 | 2.4 | 2.0 |
| Sodium triphosphate | 26.0 | 26.0 | 30.0 |
| Sodium sulphite | 7.5 | 5.0 | 4.5 |
| Sodium toluene sulphonate | 1.0 | 1.0 | 1.0 |
| Minor components + water | | up to 100% | |
| Viscosity (Rotovisko Haake MV2 at 20° C., 21 sec.$^{-1}$) in Pa.s | 0.52 | 0.435 | 0.635 |

| | A | B | C | D |
|---|---|---|---|---|
| Sodium $C_{12}$—alkylbenzene sulphonate | 5.0 | 6.0 | 5.0 | 6.0 |
| Nonionic alkoxylated alcohol | 1.8 | 2.16 | 1.8 | 2.16 |
| Fatty acid diethanol amide | 1.5 | 1.44 | 1.5 | 1.44 |
| Potassium oleate | 2.0 | 2.4 | 2.0 | 2.4 |
| Sodium triphosphate | 26.0 | 26.0 | 30.0 | 22.0 |
| Sodium sulphite | 7.5 | 5.0 | 4.5 | 5.0 |
| Sodium toluene sulphonate | — | — | — | — |
| Minor components + water | | up to 100% | | |
| Viscosity (Rotovisko Haake MV2 at 20° C., 21 sec.$^{-1}$) in Pa.S | Paste | Paste | Paste | 0.8 |

The foregoing results show that Compositions I, II and III of the invention have viscosities below 0.7 Pascal seconds, whereas Compositions A, B and C were very thick, paste-like products having a viscosity of >3 Pa·s. Even Composition D, containing a reduced amount of sodium triphosphate, showed a viscosity of 0.8 Pa·s, i.e. above the desired upper level of 0.7 Pa·s.

Compositions I, II and III were of excellent physical and chemical stability.

EXAMPLES IV–V

| Composition (wt. %) | IV | V |
|---|---|---|
| Sodium $C_{12}$—alkylbenzene sulphonate | 5.0 | 6.0 |
| Nonionic ethoxylated alcohol | 1.8 | 2.16 |
| Fatty acid diethanolamide | 1.5 | 1.44 |
| Potassium oleate | 2.0 | 2.4 |
| Sodium triphosphate | 25.0 | 25.0 |
| Sodium carboxymethyl cellulose | 0.1 | 0.1 |
| Fluorescent whitening agent | 0.1 | 0.1 |
| Perfume | 0.3 | 0 3 |
| Sodium sulphite | 5.5 | 5.5 |
| Sodium toluene sulphonate | 0.99 | 1.2 |
| Water | up to 100% | |
| Viscosity at 20° C./21 sec.$^{-1}$ Pa.s | 0.37 | 0.55 |
| Physical and chemical stability | excellent | |

EXAMPLE VI

The Examples given in the following Table illustrate the variation of stability and viscosity as function of nonionic levels for 3 hydrotrope contents.

TABLE

| Formulae | Base* | Nonionics (x) | Hydrotrope (y) | Viscosity at 20° C. 21 sec.$^{-1}$ | Stability |
|---|---|---|---|---|---|
| 1 | + | 3.84 | 1.12 SXS | 0.49 Pa.s | good |
| 2 | + | 4.32 | 1.12 SXS | 0.60 Pa.s | very good |
| 3 | + | 5.04 | 1.12 SXS | 0.65 Pa.s | good |
| 4 | + | 3.84 | 1.32 SXS | 0.53 Pa.s | moderate |

TABLE-continued

| Formulae | Base* | Nonionics (x) | Hydrotrope (y) | Viscosity at 20° C. 21 sec.$^{-1}$ | Stability |
|---|---|---|---|---|---|
| 5 | + | 4.32 | 1.32 SXS | 0.56 Pa.s | moderate |
| 6 | + | 5.04 | 1.32 SxS | 0.66 Pa.s | moderate |
| 7 | + | 3.84 | 1.52 SXS | 0.59 Pa.s | moderate |
| 8 | + | 4.32 | 1 52 SXS | 0.624 Pa.s | moderate |
| 9 | + | 5.04 | 1.52 SXS | 0.99 Pa.s | moderate |

*Note:

| Base formulation | % by weight |
|---|---|
| Sodium $C_{12}$—alkylbenzene sulphonate | 6.60 |
| Potassium oleate | 1.10 |
| Ethoxylated alcohol/diethanolamide | x |
| Sodium triphosphate | 26.00 |
| Sodium carboxymethyl cellulose | 0.10 |
| Fluorescent whitening agent | 0.10 |
| Perfume | 0.30 |
| Sodium sulphite | 7.00 |
| Hydrotrope (sodium xylene sulphonate) | y |
| Water | up to 100 |

Formulae 1–8 have viscosities <0.7 Pascal seconds. Formula 9, containing 5.04% of nonionic surfactant and 1.52 SXS, shows a viscosity above the desired upper level of 0.7 Pascal seconds and is less preferred.

EXAMPLE VII

| Composition | (% by weight) |
|---|---|
| Sodium $C_{12}$—alkylbenzene sulphonate | 5.0 |
| Potassium oleate | 2.0 |
| Nonionic alkoxylated alcohol | 1.8 |
| Lauric diethanolamide | 1.5 |
| Sodium triphosphate | 26.0 |
| Sodium carboxymethyl cellulose | 0.1 |
| Glycerol | 3.0 |
| Sodium pentaborate 10 aq. | 1.5 |
| Fluorescent whitening agent | 0.1 |
| Perfume | 0.3 |
| Enzyme granules | 0.8 |
| Sodium sulphite | 7.5 |
| Sodium toluene sulphonate | 1.0 |
| Water | up to 100 |
| Viscosity at 20° C./21 sec.$^{-1}$ | 0.46 Pa.s |

The liquid composition was prepared by feeding 750 g water to a 5 liter vessel provided with a stirrer. The appropriate amounts of sodium alkyl benzene sulphonate, potassium oleate, sodium carboxymethyl cellulose, glycerol and sodium toluene sulphonate, all in aqueous solution, were introduced successively and mixed into the water with moderate stirring and slight heating. Thereafter, pentaborate, sodium sulphite and fluoroescent agent were mixed in. Heating was stopped and sodium triphosphate was introduced and mixed with the aqueous solution with constant stirring until a homogeneous mass was obtained. Subsequently, the appropriate amounts of nonionic ethoxylate and diethanol amide were mixed into the mass. The mixture was then allowed to cool while being constantly agitated and thereafter additional water and perfume were added.

When the sodium toluene sulphonate (STS) was left out or replaced by ethanol or urea on the same weight basis, the following viscosity data were obtained:

−STS viscosity 1.16 Pa·s

+ethanol viscosity 1.09 Pa·s

+urea viscosity 1.07 Pa·s, showing that in this formula ethanol and urea are substantially ineffective.

I claim:

1. A low viscosity built liquid detergent composition comprising:

(i) from 22 to 32% by weight of sodium triphosphate;

(ii) from 6 to 15% by weight of an active detergent mixture of (a) a water-soluble anionic sulphonate or sulphate detergent;

(b) an alkali metal soap of fatty acids having from 12 to 18 carbon atoms;

(c) a nonionic detergent; in a weight ratio of (a):(b):(c) of (4.5–8.5):(0–3):(1.5–4);

(iii) from 2 to 10% by weight of an alkali metal sulphite; and (iv) from 0.2 to 2% by weight of a non-detergent short-chain alkyl-substituted benzene sulphonate having 1–4 carbon atoms in the alkyl substituent(s); the liquid detergent composition characterized by a viscosity of not more than 0.7 Pascal seconds when measured at 20° C. and at 21 seconds$^{-1}$ shear rate.

2. A liquid detergent composition according to claim 1, comprising 4–8% by weight of said alkali metal sulphite and 0.5–1.5% by weight of said short-chain alkyl-substituted benzene sulphonate.

3. A liquid detergent composition according to claim 1, comprising not more than 5% by weight of said nonionic detergent.

4. A liquid detergent composition according to claim 1, wherein said alkali metal sulphite is sodium sulphite.

5. A liquid detergent composition according to claim 1, wherein said short-chain alkyl-substituted benzene sulphonate is selected from sodium toluene sulphonate, sodium xylene sulphonate and sodium cumene sulphonate.

6. A low viscosity built liquid detergent composition comprising:

(i) from 24 to 30% by weight of sodium triphosphate;

(ii) from 8 to 14% by weight of an active detergent mixture of (a) a water-soluble anionic sulphonate or sulphate detergent;

(b) an alkali metal soap of fatty acids having from 12 to 18 carbon atoms;

(c) a nonionic detergent; in a weight ratio of (a):(b):(c) of (5.5–8.5):(0.5–3):(1.5–3);

(iii) from 4 to 8% by weight of an alkali metal sulphite; and (iv) from 0.5 to 1.5% by weight of a non-detergent short chain alkyl-substituted benzene sulphonate having 1–4 carbon atoms in the alkyl substituents(s).

* * * * *